US007905358B2

(12) United States Patent
Backes et al.

(10) Patent No.: US 7,905,358 B2
(45) Date of Patent: Mar. 15, 2011

(54) APPARATUS AND METHODS FOR FILTERING GRANULAR SOLID MATERIAL

(75) Inventors: Douglas J. Backes, Centerville, UT (US); Clay B. Poulter, Liberty, UT (US); Max R. Godfrey, Riverside, UT (US); Dennis K. Tolman, Brigham, UT (US); Melinda S. Dutton, Ogden, UT (US)

(73) Assignee: Alliant Techsystems Inc., Minneapolis, MN (US)

( * ) Notice: Subject to any disclaimer, the term of this patent is extended or adjusted under 35 U.S.C. 154(b) by 0 days.

(21) Appl. No.: 11/482,881

(22) Filed: Jul. 7, 2006

(65) Prior Publication Data

US 2008/0006563 A1 Jan. 10, 2008

(51) Int. Cl.
*B07B 1/49* (2006.01)

(52) U.S. Cl. ..... 209/397; 209/274; 209/281; 209/353; 209/355; 210/318; 210/321.77; 210/321.86; 210/346

(58) Field of Classification Search ..... 209/274, 209/281, 353, 355, 397; 210/318, 321.77, 210/321.86, 346
See application file for complete search history.

(56) References Cited

U.S. PATENT DOCUMENTS 0,019,175 A 1/1858 Hoyt et al.
0,297,382 A 4/1884 Golding
0,380,839 A 4/1888 Wemple
0,543,221 A 7/1895 Slattery
0,719,942 A 2/1903 Hermann
0,832,012 A 9/1906 Custard
1,051,267 A 1/1913 Rombauer
1,078,380 A 11/1913 Reynolds
1,104,112 A 7/1914 Hamilton
1,135,304 A 4/1915 Liggett et al.
1,136,293 A 4/1915 Sutton et al.
1,621,949 A 3/1927 Overstrom
1,710,208 A 4/1929 Deitz, Jr.
1,920,972 A 8/1933 Deister
1,999,000 A 4/1935 Tromp
2,016,972 A 10/1935 Schieferstein
2,125,812 A 8/1938 Robertson
2,271,662 A 2/1942 Rubissow
2,274,700 A 3/1942 Jenks
2,365,179 A 12/1944 Egedal
2,496,077 A 1/1950 Wehner
2,926,785 A 3/1960 Sander
2,964,187 A 12/1960 Riedel
3,018,891 A 1/1962 Bergstrom
3,021,952 A 2/1962 Powell
3,049,235 A 8/1962 Newburg
3,075,337 A * 1/1963 Andreae ..... 55/446
(Continued)

FOREIGN PATENT DOCUMENTS

DE 3505792 A1 * 8/1985

*Primary Examiner* — Stefanos Karmis
*Assistant Examiner* — Kalyanavenkateshware Kumar
(74) *Attorney, Agent, or Firm* — Traskbritt

(57) ABSTRACT

Apparatuses for screening granular solid particulate material include a generally planar first screen and a second screen. A plurality of apertures extends through the first screen. At least a portion of the second screen is oriented at an angle to the first screen, and apertures extend through a perforated region of the second screen. The second screen includes at least one region configured to prevent at least some particles of solid material from passing through the second screen.

3 Claims, 6 Drawing Sheets

U.S. PATENT DOCUMENTS 3,087,618 A 4/1963 Musschoot et al.
3,486,627 A * 12/1969 Pearson, Jr. et al. ..... 210/486
3,545,705 A 12/1970 Hodgson
3,623,614 A * 11/1971 Schmidt, Jr. ..... 210/486
3,716,138 A 2/1973 Lumsden
3,843,476 A 10/1974 Kramer
3,938,664 A 2/1976 Hartley et al.
3,963,605 A 6/1976 Seabourn
4,351,719 A 9/1982 Morey
4,491,517 A 1/1985 Janovac
4,600,622 A 7/1986 Carlson et al.
4,678,578 A 7/1987 Nodes et al.
4,823,017 A 4/1989 Hsieh
4,902,418 A * 2/1990 Ziegler ..... 210/321.77
4,968,423 A * 11/1990 McKale et al. ..... 210/346
4,976,854 A 12/1990 Yano et al.
5,051,118 A * 9/1991 Andreae ..... 95/268
5,057,217 A * 10/1991 Lutz et al. ..... 210/346
5,221,008 A 6/1993 Derrick, Jr. et al.
5,331,106 A * 7/1994 Spas ..... 423/130
5,405,015 A * 4/1995 Bhatia et al. ..... 209/524
5,626,234 A 5/1997 Cook et al.
5,647,982 A 7/1997 Haythornthwaite
5,699,918 A * 12/1997 Dunn ..... 209/397
6,161,700 A 12/2000 Bakula
6,383,395 B1 * 5/2002 Clarke et al. ..... 210/683
6,874,499 B2 4/2005 Viner et al.
7,000,776 B2 2/2006 Winkler et al.
7,017,754 B2 3/2006 Sato et al.

* cited by examiner

APPARATUS AND METHODS FOR FILTERING GRANULAR SOLID MATERIAL

STATEMENT REGARDING FEDERALLY SPONSORED RESEARCH OR DEVELOPMENT

This invention was made with Government support under Contract No. NAS8-97238 awarded by the National Aeronautics and Space Administration (NASA). The Government has certain rights in this invention.

FIELD OF THE INVENTION

The present invention relates to apparatuses for filtering or screening granular solid materials, and to methods of filtering or screening solid material.

BACKGROUND OF THE INVENTION

There are innumerable applications in a wide range of industries in which it is necessary or desirable to filter or screen granular solid material. For example, in the agriculture industry, it is necessary to filter grain (for example, wheat, barley, and oats) to remove contaminant material prior to refining and processing the grain for human consumption. As another example, in the oil drilling industry, it is often necessary to filter formation cuttings and debris from drilling fluid prior to pumping the drilling fluid to the bottom of a well borehole being drilled. As yet another example, in the mining industry, it is often necessary or desirable to filter or screen ores from formation cuttings prior to further processing.

One common structure for such filters or screens includes an interwoven fabric or mesh of wires. Each of a first plurality of wires extends in a first direction generally parallel to one another, while each of a second plurality of wires extends generally perpendicular to the wires of the first plurality. Each wire extends through the mesh structure weaving over and under (in an alternating pattern) the wires extending perpendicular thereto. The resulting screen includes a plurality of apertures extending therethrough that have a generally square or rectangular cross-sectional shape. Such filters or screens are discussed in, for example, U.S. Pat. No. 1,078,380 to Reynolds, U.S. Pat. No. 2,926,785 to Sander, U.S. Pat. No. 5,626,234 to Cook et al., and U.S. Pat. No. 6,161,700 to Bakula.

In another common structure for such filters or screens, a plurality of apertures or holes is formed in a substantially planar sheet of material. Such filters or screens are discussed in, for example, U.S. Pat. No. 719,942 to Hermann, U.S. Pat. No. 832,012 to Custard, U.S. Pat. No. 2,496,077 to Wehner, U.S. Pat. No. 3,018,891 to Bergstrom, and U.S. Pat. No. 3,843,476 to Kramer.

Filters and screens are often vibrated while passing material therethrough to prevent agglomeration of the material, clogging of the screen, and to increase the overall rate at which the material passes through the screen.

The ability of solid particles of material to pass through a screen is at least partially a function of the size and shape of the granular material and the size and shape of the apertures of the screen. One problem that may be encountered with such filters or screens relates to contaminant matter in the form of elongated particles. For example, if a particular solid granular material comprises generally spherical particles having an average particle size (e.g., diameter), elongated particles of contaminant matter having an average length greater than the average particle size of the granular material, but cross-sectional dimensions that are smaller than the average particle size of the granular material, may be difficult to entirely remove, screen, or filter from the granular material.

A screen as described above may be used in an attempt to remove the elongated particles of contaminant matter from the granular material. The apertures extending through the screen may have a size and shape selected to allow the granular material to pass through the apertures, while preventing as many of the elongated particles of contaminant matter as possible from passing through the apertures. In other words, the apertures in the screen may have cross-sectional dimensions that are greater than the average particle size of the granular material, but less than the length of the elongated particles of contaminant matter. If, however, an elongated particle of contaminant matter has cross-sectional dimensions that are less than the average particle size of the granular material (and the cross-sectional dimensions of the apertures in the screen), and the elongated particle happens to be oriented such that a longitudinal axis of the elongated particle is oriented generally perpendicular to the screen, the elongated particle of contaminant matter may be capable of passing through an aperture in the screen. As a result, such filters or screens may be incapable of removing all elongated particles of contaminant matter from granular solid material.

BRIEF SUMMARY OF THE INVENTION

In one aspect, the present invention includes an apparatus for screening solid material. The apparatus includes a first screen and a second screen disposed adjacent the first screen. The first screen may be generally planar and may include a plurality of apertures extending therethrough. The second screen includes at least one region that is disposed at an angle relative to the first screen and at least one perforated region that includes a plurality of apertures extending therethrough. In some embodiments of the present invention, the second screen may further include at least one non-perforated region configured to prevent at least some particles of solid material from passing through the second screen. Furthermore, in some embodiments of the present invention, at least a portion of the second screen may be pleated. Such a pleated second screen may include a plurality of substantially planar regions, each of which may be oriented at an angle relative to the first screen. For example, each substantially planar region may be oriented at an acute angle of between about 20 degrees and about 70 degrees relative to the first screen. Each substantially planar region may include at least one non-perforated region configured to prevent at least some granular solid material from passing through the pleated second screen.

In another aspect, the present invention includes methods of screening solid material. According to the methods, particles of solid material are passed through a composite screen. In particular, particles of solid material may be passed through a first plurality of apertures in a generally planar first screen. At least some of the particles of solid material also may be passed through a second plurality of apertures in a perforated region of a second screen. The perforated region of the second screen may be disposed adjacent the first screen and oriented at an angle relative to the first screen. Some of the particles may be retained on a non-perforated region of the second screen to prevent those particles from passing through the second screen.

BRIEF DESCRIPTION OF THE SEVERAL VIEWS OF THE DRAWINGS

While the specification concludes with claims particularly pointing out and distinctly claiming that which is regarded as the present invention, the advantages of this invention can be more readily ascertained from the following description of the invention when read in conjunction with the accompanying drawings in which:

DETAILED DESCRIPTION OF THE INVENTION

Figure 1:
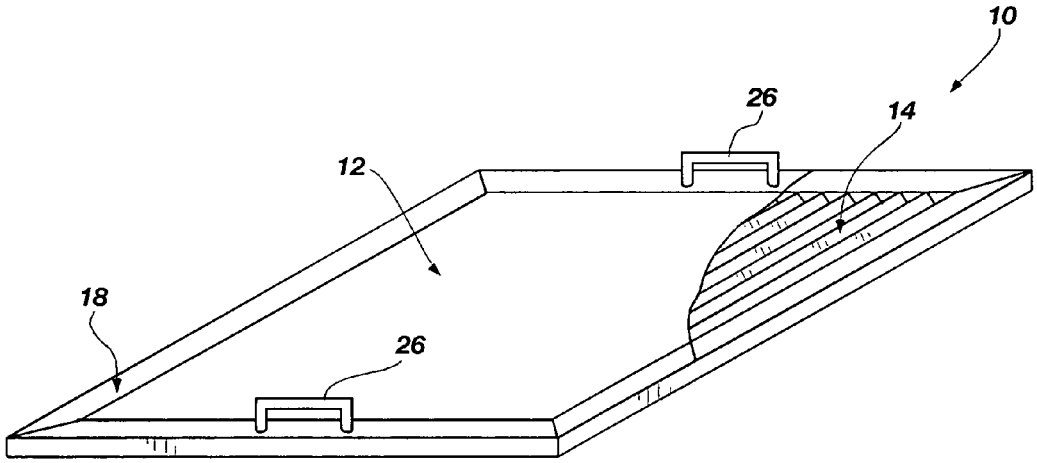
FIG. 1 is a perspective view of a composite screen assembly that embodies teachings of the present invention.

A composite screen assembly 10 that embodies teachings of the present invention is shown in FIG. 1. The composite screen assembly 10 may be used for screening or filtering contaminant matter (such as, for example, particles of a foreign material) from solid granular material. The composite screen assembly 10 includes a first screen 12 and a second screen 14. As shown in FIG. 1, the first screen 12 may be disposed adjacent the second screen 14 such that matter passing through the first screen 12 encounters the second screen 14. In the configuration shown in FIG. 1, the first screen 12 is positioned over the second screen 14. The composite screen assembly 10 optionally may include a frame assembly 18. Furthermore, one or more handles 26 may be provided on the composite screen assembly 10 to facilitate handling thereof.

Figure 2:
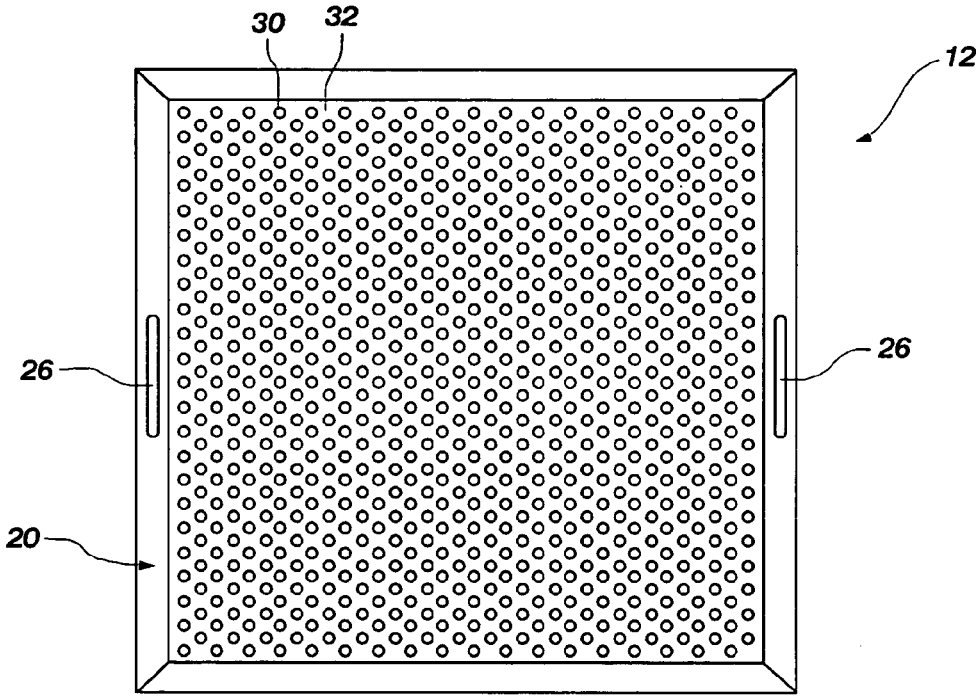
FIG. 2 is a plan view of a first screen of the composite screen assembly shown in FIG. 1.

FIG. 2 is a plan view of a first screen of the composite screen assembly shown in FIG. 1. Referring to FIG. 2, the first screen 12 may be generally planar. The first screen 12 may include a plurality of apertures 30 formed through a substantially planar layer of material 32 of the first screen 12. By way of example and not limitation, the substantially planar layer of material 32 may be a layer of sheet metal. In additional embodiments, the substantially planar layer of material 32 may include a polymer material (such as, for example, polyurethane or polyethylene), a ceramic material (such as, for example, alumina, silica, zirconia, or silicon nitride), or any other solid material. The apertures 30 may be disposed in a selected, ordered array across the first screen 12. By way of example and not limitation, the apertures 30 may be disposed in a plurality of rows and columns. As an example, the apertures 30 may be disposed in a hexagonal pattern (often referred to as a triangular pattern), as shown in FIG. 2. In additional embodiments, it is contemplated that the apertures 30 may be disposed in a square pattern, a rectangular pattern, or any other pattern. Furthermore, the first screen 12 may include a fabric or mesh of interwoven wires, thread, fibers, etc.

Figure 3:
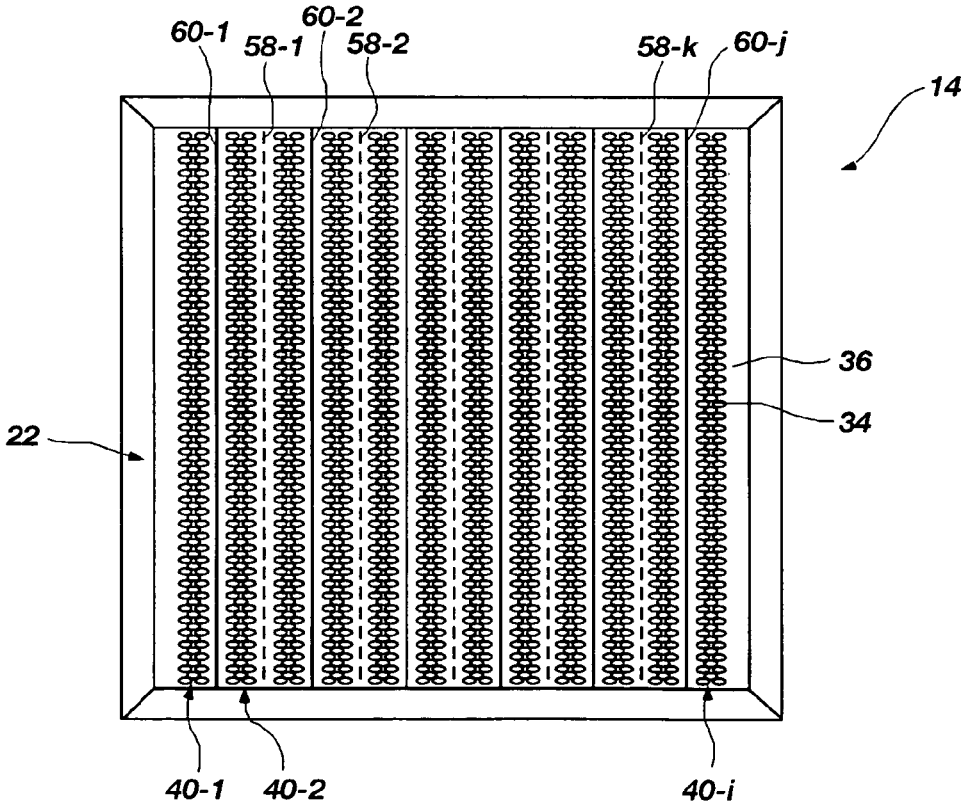
FIG. 3 is a plan view of a second screen of the composite screen assembly shown in FIG. 1.

The second screen 14 of the composite screen assembly 10 (FIG. 1) is shown in FIG. 3. The second screen 14 includes a plurality of apertures 34 formed through a layer of material 36. The layer of material 36 of the second screen 14 may be formed from or include the same material used to form the layer of material 32 of the first screen 12. In additional embodiments, the layer of material 36 of the second screen 14 and the layer of material 32 of the first screen 12 may be formed from or include different materials.

In the embodiment shown in FIG. 3, the second screen 14 is not substantially planar. In contrast to the first screen 12, the layer of material 36 of the second screen 14 may have an accordion or pleated structure in which a plurality of alternating folds define a plurality of substantially planar regions 40-1, 40-2 . . . **40-*i*, each of which may be disposed at an angle relative to adjacent substantially planar regions 40-1, 40-2 . . . 40-*i* and the first screen 12**.

The first screen 12 may include a first frame member 20, as shown in FIG. 2, and the second screen 14 may include a second frame member 22, as shown in FIG. 3. When the first screen 12 is positioned over and adjacent the second screen 14 to form the composite screen assembly 10 shown in FIG. 1, the first frame member 20 and the second frame member 22 together may form the frame assembly 18 shown in FIG. 1. Optionally, the first frame member 20 may be welded, bolted, or otherwise secured to the second frame member 22. In additional embodiments, the first frame member 20 may simply rest upon the second frame member 22, or a snap-fit may be provided between the first frame member 20 and the second frame member 22, when the composite screen assembly 10 is being used to filter a particular solid material. Furthermore, complementary features may be formed on the first frame member 20 and the second frame member 22 to facilitate alignment of the first frame member 20 with the second frame member 22. By way of example, a plurality of pins (not shown) may be provided that extend from a surface of the first frame member 20, and a plurality of complementary holes configured to receive the pins may be provided in an opposing surface of the second frame member 22, or vice versa. Complementary ridges and grooves, or any other complementary alignment features, may be used in place of, or in addition to, pins and holes.

Figure 4:
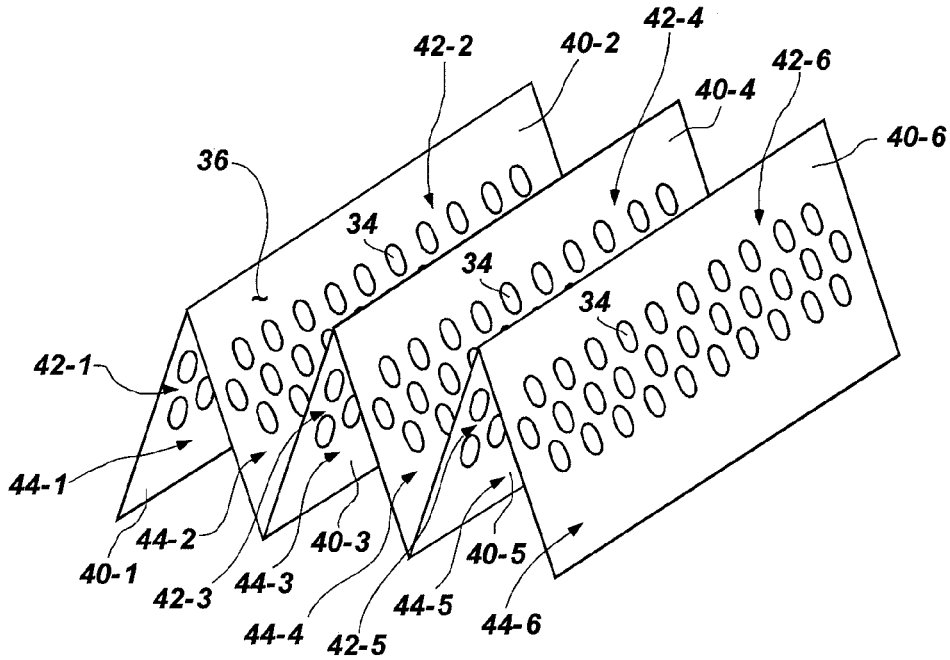
FIG. 4 is a perspective view of a portion of the second screen shown in FIG. 3.

FIG. 4 is an enlarged perspective view of a portion of the layer of material 36 of the second screen 14. As shown therein, the apertures 34 may be located in a perforated region 42-1, 42-2 . . . **42-*l* of each substantially planar region 40-1, 40-2 . . . 40-*i* of the second screen 14. Furthermore, each substantially planar region 40-1, 40-2 . . . 40-*i* of the second screen may include at least one substantially non-perforated region 44-1, 44-2 . . . 44-*m*, in which no apertures 34** are provided.

The apertures 34 may be disposed in a selected, ordered array across the second screen 14 in each of the perforated regions 42-1, 42-2 . . . **42-*l* thereof. By way of example and not limitation, the apertures 34 may be disposed in a plurality of rows and columns. As an example, the apertures 34 may be disposed in a hexagonal pattern (often referred to as a triangular pattern), as shown in FIG. 4. In additional embodiments, the apertures 34** may be disposed in a square pattern, a rectangular pattern, or any other pattern or substantially ordered array.

In some embodiments of the invention, each of the perforated regions 42-1, 42-2 . . . **42-*l* may have a width, measured as the width of the smallest rectangle capable of encompassing each of the apertures 34 extending therethrough, that is between about 35% and about 65% of a width of each of the substantially planar regions 40-1, 40-2 . . . 40-*i* of the second screen 14. In one particular embodiment of the invention, set forth merely as an example, each of the perforated regions 42-1, 42-2 . . . 42-*l* may have a width, measured as the width of the smallest rectangle capable of encompassing each of the apertures 34 extending therethrough, that is about 12.7 millimeters (½ of an inch), and each of the substantially planar regions 40-1, 40-2 . . . 40-*i* of the second screen 14 may have a width that is about 25.4 millimeters (about 1 inch). Furthermore, in some embodiments of the present invention, each of the perforated regions 42-1, 42-2 . . . 42-*l* may be generally centered within each of the respective substantially planar regions 40-1, 40-2 . . . 40-*i* of the second screen 14**.

Figure 5:
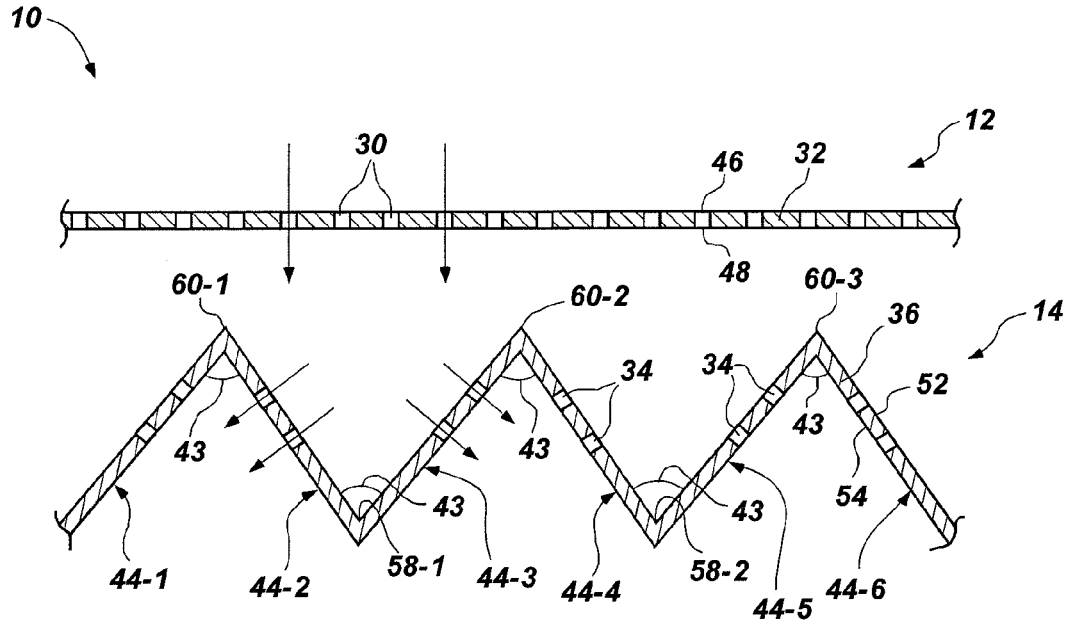
FIG. 5 is a cross-sectional view of a portion of the composite screen assembly shown in FIG. 1.

FIG. 5 is a partial cross sectional view of the composite screen assembly 10 (FIG. 1) illustrating the first screen 12 and the second screen 14. As shown therein, the layer of material 32 of the first screen 12 includes a first major surface 46 and an opposing second major surface 48. Similarly, the layer of material 36 of the second screen 14 includes a first major surface 52 and an opposing second major surface 54. The first major surface 52 of the layer of material 36 is on a side of the second screen 14 generally facing the first screen 12. The alternating folds of the accordion or pleated second screen 14 may define a plurality of concave edges, each of which defines a valley 58-1, 58-2 . . . **58-*k*, and a plurality of convex edges, each of which defines a peak 60-1, 60-2 . . . 60-*j*. The concave edges defining the valleys 58-1, 58-2 . . . 58-*k* and the convex edges defining the peaks 60-1, 60-2 . . . 60-*j* each extend along the first major surface 52 of the layer of material 36 of the second screen 14. As used herein, the term "concave edge" means any edge defined at the intersection between two intersecting surfaces wherein the angle between the intersecting surfaces adjacent the edge is less than 180 degrees. As used herein, the term "convex edge" means any edge defined between two intersecting surfaces wherein the angle between the surfaces adjacent the edge is greater than 180 degrees. Such intersecting surfaces may be planar, curved, or may have any shape. In this manner, the plurality of concave edges form a plurality of valleys 58-1, 58-2 . . . 58-*k* on the first major surface 52 of the second screen 14, while the plurality of convex edges form a plurality of peaks 60-1, 60-2 . . . 60-*j* on the first major surface 52 of the second screen 14**.

As shown in FIG. 5, the non-perforated regions 44-1, 44-2 . . . **44-*m* of each substantially planar region 40-1, 40-2 . . . 40-*i* of the second screen 14 may be disposed adjacent the valleys 58-1, 58-2 . . . 58-*k*. As illustrated in FIG. 3, the plurality of valleys 58-1, 58-2 . . . 58-*k* and the plurality of peaks 60-1, 60-2 . . . 60-*j* may be substantially linear (i.e., extending in a substantially straight direction), and may extend substantially parallel to one another across the second screen 14. In this configuration, each substantially planar region 40-1, 40-2 . . . 40-*i* may have a substantially identical rectangular shape. In additional embodiments, the plurality of valleys 58-1, 58-2 . . . 58-*k* and the plurality of peaks 60-1, 60-2 . . . 60-*j* may be non-linear and may not extend in a parallel manner across the second screen 14. In such a configuration, the substantially planar regions 40-1, 40-2 . . . 40-*i* may have different shapes. Furthermore, each of the valleys 58-1, 58-2 . . . 58-*k* may be substantially disposed in a single plane, and each of the peaks 60-1, 60-2 . . . 60-*j* may be substantially disposed in a single plane. In additional embodiments, the valleys 58-1, 58-2 . . . 58-*k* may not be disposed in a single plane, and the peaks 60-1, 60-2 . . . 60-*j*** may not be disposed in a single plane.

Referring again to FIG. 5, each substantially planar region 40-1, 40-2 . . . **40-*i* may be oriented at an angle 43 relative to adjacent substantially planar regions 40-1, 40-2 . . . 40-*i*. By way of example and not limitation, each angle 43 may be between about 20 degrees and about 70 degrees. More particularly, each angle 43 may be between about 40 degrees and about 50 degrees. In one particular embodiment, set forth merely as an example, each angle 43 may be approximately 45 degrees. Furthermore, each substantially planar region 40-1, 40-2 . . . 40-*i* may be oriented at an angle relative to the first screen 12. By way of example and not limitation, each substantially planar region 40-1, 40-2 . . . 40-*i* may be oriented at an acute angle between about 20 degrees and about 80 degrees relative to the first screen 12. More particularly, each substantially planar region 40-1, 40-2 . . . 40-*i* may be oriented at an acute angle between about 40 degrees and about 80 degrees relative to the first screen 12. In one particular embodiment, set forth merely as an example, each substantially planar region 40-1, 40-2 . . . 40-*i* may be oriented at an acute angle of about 67.5 degrees relative to the first screen 12**.

The non-perforated regions 44-1, 44-2 . . . **44-*m* of each substantially planar region 40-1, 40-2 . . . 40-*i* of the second screen 14 may be disposed adjacent the valleys 58-1, 58-2 . . . 58-*k*. In this configuration, the non-perforated regions 44-1, 44-2 . . . 44-*m* may be configured to prevent at least some material from passing through the second screen 14 when the material is being screened or filtered using the composite screen assembly 10. As shown in FIG. 5, to filter material (not shown) using the composite screen assembly 10, the composite screen assembly 10 may be oriented substantially horizontally (relative to the gravitational field), and particulate material may be poured, dumped, or otherwise provided on the first major surface 46 of the first screen 12. At least some of the material may pass through the apertures 30 of the first screen 12, as indicated by the directional arrows. As material passes through the apertures 30 of the first screen, the material falls onto the first major surface 52 of the second screen 14. At least some of the material may fall onto the non-perforated regions 44-1, 44-2 . . . 44-*m* of the second screen 14. This material may be collected in the valleys 58-1, 58-2 . . . 58-*k* adjacent the non-perforated regions 44-1, 44-2 . . . 44-*m*. At least some of the material falling onto the first major surface 52 of the second screen 14 may pass through the apertures 34 of the second screen 14, as indicated by the directional arrows. As shown in FIG. 5, the directional arrows passing through the apertures 34 of the second screen 14 are oriented at an angle with respect to the directional arrows passing through the apertures 30 of the first screen 12**.

In this configuration, as particles or granules of material pass through the composite screen assembly 10, the particles must change direction at least one time as the particles pass through the first screen 12 and the second screen 14. This change in direction may hinder or prevent elongated contaminant particles from passing through the composite screen assembly. For example, elongated particles of contaminant matter may have cross-sectional dimensions that allow the elongated particles to pass through the apertures 30 of the first screen 12 (and the apertures 34 of the second screen) when the longitudinal axes of the elongated particles are appropriately oriented relative to the apertures 30 of the first screen 12. The elongated particles of contaminant matter may have longitudinal dimensions that prevent the elongated particles from passing through the apertures 30 of the first screen 12 (and/or the apertures 34 of the second screen 14) when the longitudinal axes of the elongated particles are oriented generally transverse to the apertures 30 of the first screen 12 (and/or the apertures 34 of the second screen 14). If elongated particles of contaminant matter happen to be aligned with and pass through an aperture 30 of the first screen 12, such elongated particles are likely to be oriented generally transverse relative to the apertures 34 of the second screen 14, and therefore, may be unlikely to pass through the apertures 34 of the second screen 14 and collected in the valleys 58-1, 58-2 . . . **58-*k* adjacent the non-perforated regions 44-1, 44-2 . . . 44-*m* of the second screen 14**.

Figure 6:
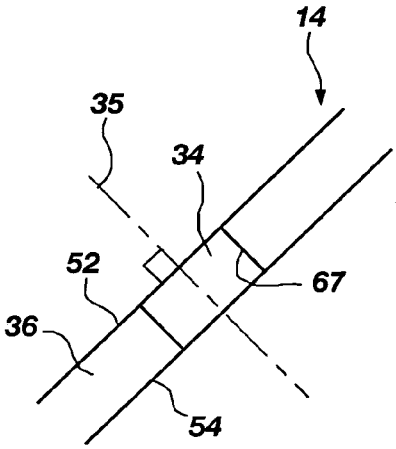
FIG. 6 is an enlarged view of a portion of FIG. 5 illustrating the orientation of an aperture extending through the second screen of the composite screen assembly.
Figure 7:
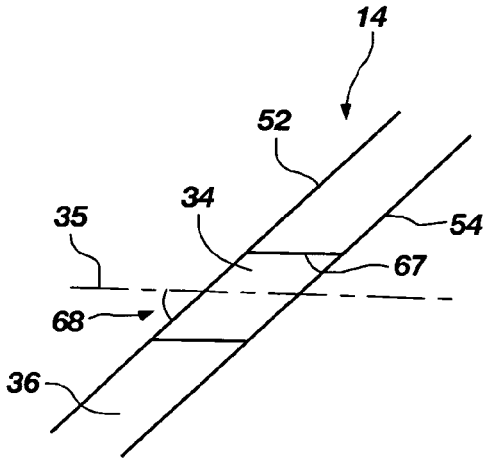
FIG. 7 is an enlarged view like that of FIG. 6 illustrating an additional embodiment of a second screen that may be used with the composite screen assembly of FIG. 1, in which the apertures extending through the second screen are oriented at an angle relative to a surface of the screen.

FIG. 6 is an enlarged view of a portion of the second screen 14 illustrating an aperture 34 that has been formed through the layer of material 36 of the second screen 14 from the first major surface 52 to the second major surface 54 thereof. As shown in FIG. 6, in some embodiments of the present invention, the apertures 34 may be defined by a substantially cylindrical surface 67 of the layer of material 36 of the second screen 14. In this configuration, each aperture 34 may have a generally circular cross-sectional shape and a longitudinal axis 35. In some embodiments, the longitudinal axis 35 may be oriented substantially perpendicular to the first major surface 52 of the second screen 14. As illustrated in FIG. 7, in additional embodiments of the present invention, the longitudinal axis 35 of each aperture 34 may be oriented at an angle 68 relative to the first major surface 52 of the second screen 14. In such a configuration, any elongated particles of contaminant matter that have passed through the first screen 12 may be more likely to be oriented generally transverse to the apertures 34 of the second screen 14, and therefore, unlikely to pass through the apertures 34 of the second screen 14. By way of example and not limitation, the angle 68 between the longitudinal axis 35 of each aperture 34 and the first major surface 52 of the second screen 14 may be between about 20 degrees and about 80 degrees. More particularly, the angle 68 between the longitudinal axis 35 of each aperture 34 and the first major surface 52 of the second screen 14 may be between about 40 degrees and about 80 degrees. In one particular embodiment of the present invention, set forth merely as an example, the angle 68 between the longitudinal axis 35 of each aperture 34 and the first major surface 52 of the second screen 14 may be about 67.5 degrees.

Referring again to FIG. 5, the apertures 30 of the first screen 12 may have a size and shape that is substantially identical to the size and shape of the apertures 34 of the second screen 14. In other embodiments, the apertures 30 of the first screen 12 may have a size that differs from a size of the apertures 34 of the second screen 14, a shape that differs from a shape of the apertures 34 of the second screen 14, or both a size and shape that differs from a size and shape of the apertures 34 of the second screen 14. By way of example and not limitation, each of the apertures 30 of the first screen 12 and the apertures 34 of the second screen 14 may have a substantially circular cross-sectional shape.

In some embodiments of the present invention, the substantially uniform diameter of the apertures 30 of the first screen 12 may be between about 1.1 times and about 15 times an average particle size of particles of solid material to be screened using the composite screen assembly 10. More particularly, the substantially uniform diameter of the apertures 30 of the first screen 12 may be between about 5 times and about 10 times an average particle size of the particles of solid material to be screened using the composite screen assembly 10. Furthermore, in some embodiments of the present invention, the apertures 34 of the second screen 14 may have a substantially uniform diameter that is between about 1.3 and about 1.7 times the substantially uniform diameter of the apertures 30 of the first screen 12.

In one particular embodiment, set forth merely as an example, a solid particulate material may have an average particle size of about 0.20 millimeter, the apertures 30 of the first screen 12 may have a substantially uniform diameter of between about 0.22 millimeter and about 3.00 millimeters, and the apertures 34 of the second screen 14 may have a substantially uniform diameter between about 2.85 millimeters and about 5.10 millimeters. For example, the apertures 30 of the first screen 12 may have a substantially uniform diameter of about 2.40 millimeters and the apertures 34 of the second screen 14 may have a substantially uniform diameter of about 3.20 millimeters.

In some embodiments of the present invention, the apertures 30 of the first screen 12 may comprise between about 20% and about 50% of the area of the first screen 12, and the layer of material 32 may comprise between about 50% and about 80% of the area of the first screen 12. Similarly, the apertures 34 of the second screen 14 may comprise between about 10% and about 30% of the area of the second screen 14, and the layer of material 36 may comprise between about 70% and about 90% of the area of the second screen. In one particular embodiment, set forth merely as an example, the apertures 30 of the first screen 12 may comprise about 33% of the area of the first screen 12, and the layer of material 32 may comprise the remainder of the area of the first screen 12. Similarly, the apertures 34 of the second screen 14 may comprise about 20% of the area of the second screen 14, and the layer of material 36 may comprise the remainder of the area of the second screen 14.

It may be necessary or desirable when screening particulate material using the composite screen assembly 10 to determine whether any particles of contaminant matter are present in the particular material being screened. Optionally, the first screen 12 may be periodically removed during a screening process, and material that has been collected in the valleys 58-1, 58-2 . . . **58-*k* of the second screen 14 adjacent the non-perforated regions 44-1, 44-2 . . . 44-*m*** may be tested or otherwise inspected to detect the presence of any contaminant particles contained therein.

Figure 8:
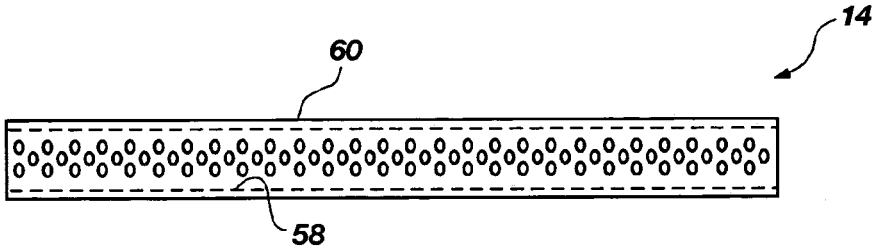
FIG. 8 is a side view of the second screen shown in FIG. 3.
Figure 9:
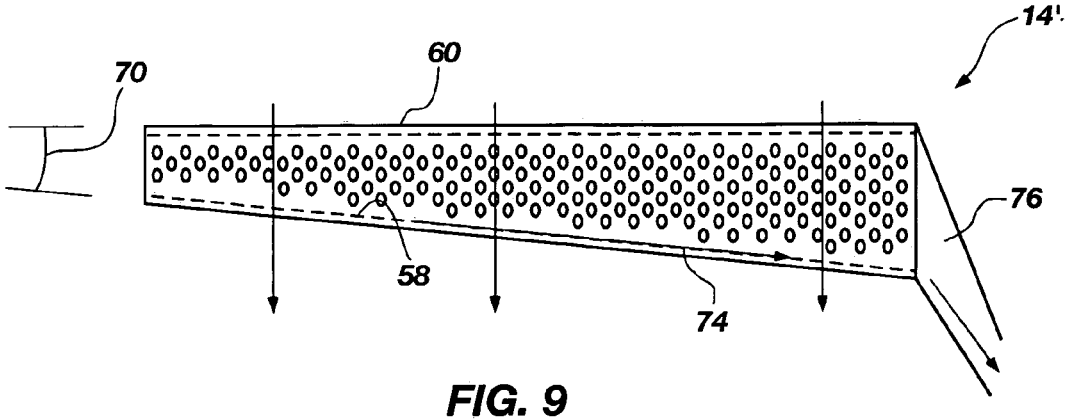
FIG. 9 is a side view like that of FIG. 8 illustrating an additional embodiment of a second screen that may be used with the composite screen assembly of FIG. 1, in which an edge or surface of the second screen extends at an angle relative to the gravitational field when material is passed through the second screen.

FIG. 8 is a side view of a portion of the second screen 14. As shown therein, the valleys 58-1, 58-2 . . . **58-*k* may extend substantially parallel across the second screen 14 relative to the peaks 60-1, 60-2 . . . 60-*j*. An additional embodiment of a second screen 14' that may be used with the composite screen assembly 10 (FIG. 1) is shown in FIG. 9. As shown therein, the valleys 58-1, 58-2 . . . 58-*k* may extend at an angle 70 across the second screen 14' relative to the peaks 60-1, 60-2 . . . 60-*j*. In this configuration, as particles of material being screened pass through the composite screen assembly 10 (FIG. 1) in the direction illustrated by the directional arrows, at least some of the particles may fall onto the non-perforated regions 44-1, 44-2 . . . 44-*m* (FIG. 5) of the second screen 14 and may be collected in the valleys 58-1, 58-2 . . . 58-*k* of the second screen 14 adjacent non-perforated regions 44-1, 44-2 . . . 44-*m*. These particles of material that are collected in the valleys 58-1, 58-2 . . . 58-*k* adjacent non-perforated regions 44-1, 44-2 . . . 44-*m* may migrate (at least partially due to gravity) down the slope that results from the angle 70 between the valleys 58-1, 58-2 . . . 58-*k* and the peaks 60-1, 60-2 . . . 60-*j* in the direction indicated by directional arrow 74**.

A funnel, chute, vacuum source or other collection device 76 configured to collect particles of material may be provided and used to collect the particles of material that migrate across the second screen 14' down the slope. In this configuration, the material that is collected by the collection device 76 may be inspected to detect the presence of contaminant matter. In the configuration shown in FIG. 9, the material that is collected by the collection device 76 may be inspected without interrupting the screening process to remove the first screen 12, as previously described herein. Furthermore, in this configuration, the material that is collected by the collection device 76 may be continuously inspected without interrupting the screening process. As a result, the efficiency of a screening process may be improved by using the second screen 14' as part of the composite screen assembly 10 previously described herein.

The composite screen assembly 10 previously described herein is illustrated as having a generally rectangular shape. Other embodiments of the present invention may have other shapes and configurations.

Figure 10:
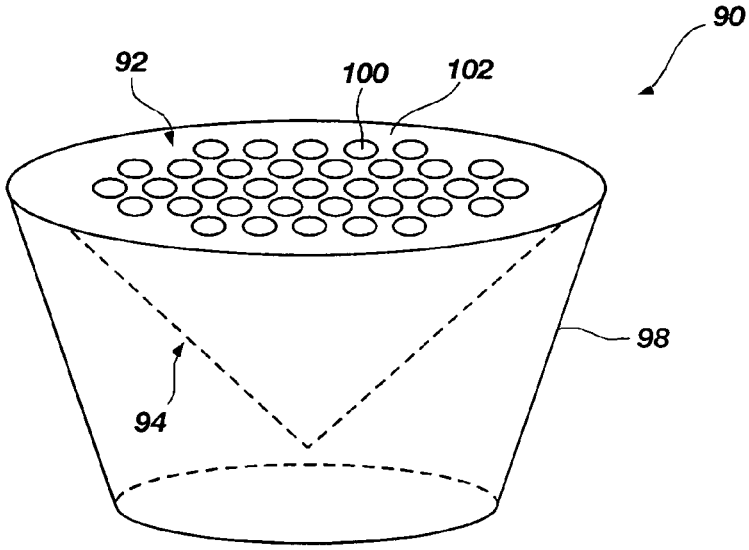
FIG. 10 is a perspective view of another composite screen assembly that embodies teachings of the present invention.
Figure 11:
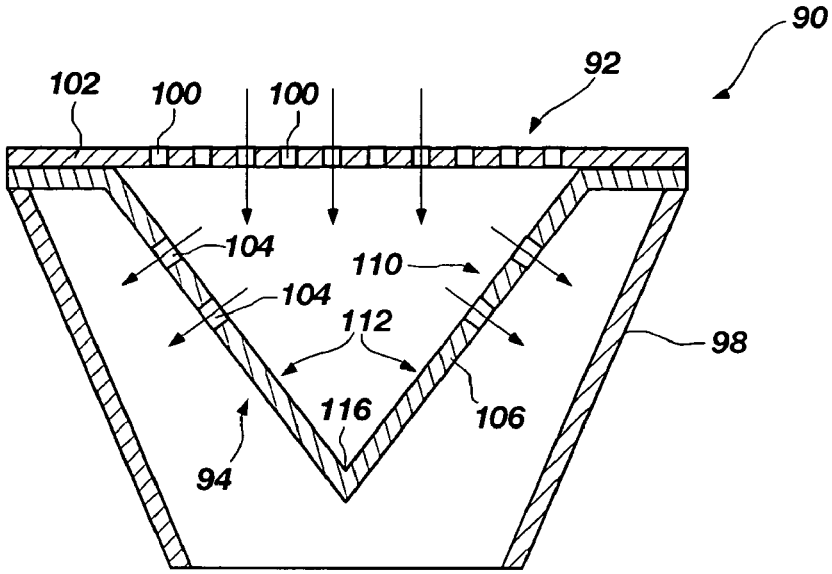
FIG. 11 is a cross-sectional view of the composite screen assembly shown in FIG. 10.

Another composite screen assembly 90 that embodies teachings of the present invention is shown in FIGS. 10 and 11. The composite screen assembly 90 includes a first screen 92 and a second screen 94. Optionally, the composite screen assembly 90 also may include a housing 98. As shown in FIGS. 10 and 11, the housing 98 may have a frustoconical shape. In additional embodiments, the housing 98 may have a generally cylindrical shape or any other shape.

Referring to FIG. 11, the first screen 92 may include a plurality of apertures 100 each extending through a layer of material 102. The second screen 94 may include a layer of material 106 that has a generally conical shape. The layer of material 106 of the second screen 94 may include a perforated region 110 in which a plurality of apertures 104 extend through the layer of material 106, and a non-perforated region 112 that is substantially free of apertures 104. As shown in FIG. 11, the non-perforated region 112 may be located below the perforated region 110 (when the composite screen assembly 90 is oriented generally horizontally with respect to gravity) and may include the bottom-most point 116 formed by the conical second screen 94. In this configuration, the non-perforated region 112 of the second screen 94 is configured to prevent at least some particles of material from passing through the second screen 94 during a screening process.

The composite screen assembly 90 may be used to filter or screen particulate material in a manner substantially similar to that previously described in relation to the composite screen assembly 10. In particular, particulate material may be poured, dumped, or otherwise provided onto the first screen 92. At least some of the particles of material may pass through the apertures 100 of the first screen 92, in the direction generally represented by the directional arrows. As particles of material pass through the apertures 100 of the first screen 92, the particles fall onto the second screen 94. At least some of the particles of material may fall onto the non-perforated region 112 of the second screen 94. These particles of material may be collected in the non-perforated region 112 of the second screen 94 and prevented from passing through the second screen 94. At least some of the particles of material may fall onto perforated region 110 of the second screen 94 and may pass through the apertures 104 of the second screen 94, in the direction generally represented by the directional arrows. As shown in FIG. 11, the directional arrows passing through the apertures 104 of the second screen 94 are oriented at an angle with respect to the directional arrows passing through the apertures 100 of the first screen 92.

In this configuration, as particles or granules of material pass through the composite screen assembly 90, the particles must change direction at least one time as the particles pass through the first screen 92 and the second screen 94. This change in direction may hinder or prevent elongated particles of foreign material from passing through the composite screen assembly in the same manner previously described in relation to the composite screen assembly 10.

Figure 12:
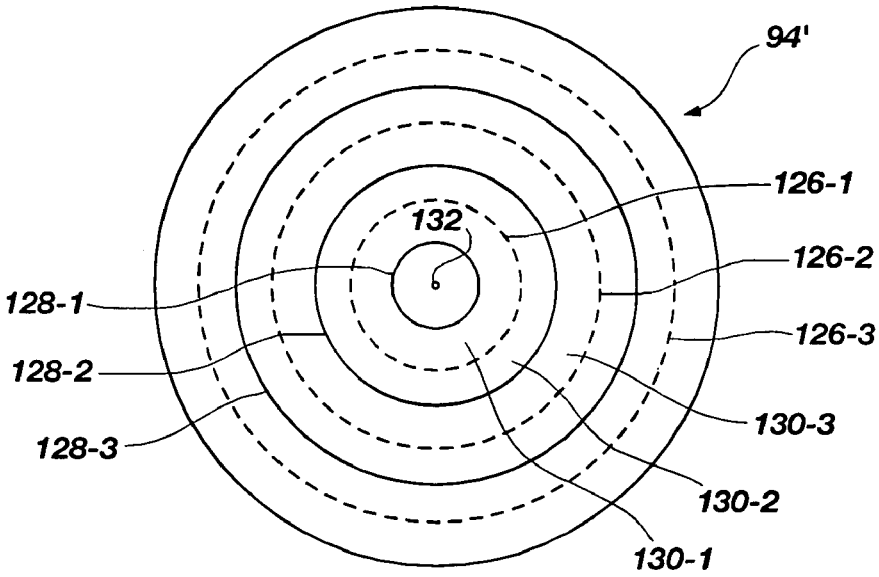
FIG. 12 is a top plan view of an additional embodiment of a screen that may be used with the composite screen assembly shown in FIG. 10.

An additional embodiment of a second screen 94' that may be used with the composite screen assembly 90 (FIGS. 10 and 11) is shown in FIG. 12. The second screen 94' may include a plurality of concentric concave edges each defining a valley 126-1, 126-2 . . . **126-*n* and a plurality of concentric convex edges each defining a peak 128-1, 128-2 . . . 128-*o*. A plurality of regions 130-1, 130-2 . . . 130-*p*, each having a generally frustoconical shape, may be defined between adjacent valley 126-1, 126-2 . . . 126-*n* and peak 128-1, 128-2 . . . 128-*o*. Each frustoconical region 130-1, 130-2 . . . 130-*p* may include a perforated region and a non-perforated region (not shown) similar to those previously described in relation to the second screen 14 (FIG. 3). The non-perforated regions may be disposed adjacent the valleys 126-1, 126-2 . . . 126-*n* in the second screen 94', in which particles of material may be collected and prevented from passing through the second screen 94'. In such a configuration, a cross-section of the second screen 94' extending through the center 132 of the second screen may appear substantially similar to the cross-sectional view of the second screen 14 shown in FIG. 5**.

During a screening or filtering process using a screen assembly that embodies teachings of the present invention (such as, for example, the composite screen assembly 10 shown in FIG. 1 and the composite screen assembly 90 shown in FIG. 10), a device configured to transmit mechanical vibrations to the screen assembly may be used to enhance the flow of particulate material through the screen assembly. Furthermore, referring again to FIG. 9, when using a second screen such as the second screen 14', mechanical vibrations transmitted to the composite screen assembly 10, and in particular the second screen 14', may facilitate migration of particulate material in the valleys of the second screen 14' down the slope that results from the angle 70 between the valleys 58-1, 58-2 . . . **58-*k* and the peaks 60-1, 60-2 . . . 60-*j* in the direction indicated by directional arrow 74 and towards the collection device 76**.

There are certain applications in which the present invention may be particularly useful. Such applications include the screening of materials that are likely to include elongated particles of contaminant matter. By way of example and not limitation, certain methods of manufacturing granular ammonium perchlorate may result in the inadvertent inclusion of elongated particles of metal with the granular ammonium perchlorate. As a result, the present invention may find particular utility in screening particles of solid ammonium perchlorate to remove elongate particles of foreign material. Furthermore, it is contemplated that screening apparatuses that embody teachings of the present invention may be used to filter or screen solid material from a liquid material. For example, a slurry or a suspension may be passed through a screening apparatus that embodies teachings of the present invention to remove at least some solid matter from the slurry or suspension.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A method of screening solid particulate ammonium perchlorate, the method comprising passing particles of solid ammonium perchlorate through a composite screen comprising:

passing the plurality of particles of solid ammonium perchlorate through a first plurality of apertures in a generally planar first screen;

passing a first fraction of the plurality of particles of solid ammonium perchlorate through a second plurality of apertures in at least one perforated region of a plurality of perforated regions of a second non-planar screen, the at least one perforated region of the second screen being disposed adjacent the first screen and oriented at an angle relative to the first screen; and retaining an additional fraction of the plurality of particles of solid ammonium perchlorate on at least one elongated, non-perforated valley region of the non-planar second screen between two perforated regions of the plurality of perforated regions to prevent the additional fraction of the plurality of particles of solid ammonium perchlorate from passing through the at least one perforated region of the plurality of perforated regions of the non-planar second screen.

2. A method of screening solid particulate material, the method comprising passing particles of solid material through a composite screen comprising:

passing a plurality of particles of solid material through a first plurality of apertures in a generally planar first screen;

passing a first fraction of the plurality of particles of solid material through a second plurality of apertures in at least one elongated, perforated, planar region of a pleated second screen having a plurality of elongated, perforated, planar regions separated from one another by alternating elongated peak regions and elongated, non-perforated valley regions, the at least one elongated, perforated, planar region of the pleated second screen being disposed adjacent the first screen and oriented at an angle relative to the first screen;

retaining an additional fraction of the plurality of particles of solid material on at least one of the elongated, non-perforated valley regions of the second screen to prevent the additional fraction of the plurality of particles of solid material from passing through the at least one elongated, perforated, planar region of the pleated second screen; and inspecting at least a portion of the additional fraction of the plurality of particles of solid material retaining on the at least one of the elongated, non-perforated valley regions of the pleated second screen.

3. The method of claim 2, wherein inspecting comprises substantially continuously inspecting the at least a portion of the additional fraction of the plurality of particles of solid material retaining on the at least one of the elongated, non-perforated valley regions of the pleated second screen while passing the first fraction of the plurality of particles of solid material through the second plurality of apertures in the at least one elongated, perforated, planar region of the pleated second screen.

* * * * *

UNITED STATES PATENT AND TRADEMARK OFFICE

CERTIFICATE OF CORRECTION

PATENT NO. : 7,905,358 B2
APPLICATION NO. : 11/482881
DATED : March 15, 2011
INVENTOR(S) : Douglas J. Backes et al.

It is certified that error appears in the above-identified patent and that said Letters Patent is hereby corrected as shown below:

On the title page:

In ITEM (75) Inventors: change "Dennis K. Tolman, Brigham," to --Dennis K. Tolman, Brigham City,--

In the specification:

| | | |
|---|---|---|
| COLUMN 4, | LINE 58, | change "screen may" to --screen **14** may-- |
| COLUMN 5, | LINE 53, | change "of the" to --(FIG. 4) of the-- |
| COLUMN 6, | LINE 42, | change "first screen," to --first screen **12**,-- |
| COLUMN 6, | LINE 61, | change "assembly." to --assembly **10**.-- |
| COLUMN 6, | LINE 64, | change "second screen)" to --second screen **14**)-- |
| COLUMN 8, | LINE 25, | change "second screen." to --second screen **14**.-- |
| COLUMN 10, | LINE 24, | change "second screen may" to --second screen **94**' may-- |

Signed and Sealed this
Thirteenth Day of September, 2011

David J. Kappos

David J. Kappos
*Director of the United States Patent and Trademark Office*